US007611044B1

(12) United States Patent
Wilson

(10) Patent No.: US 7,611,044 B1
(45) Date of Patent: Nov. 3, 2009

(54) MAILBOX

(76) Inventor: Walter T. Wilson, 2049 Tacoma, Stanton, MI (US) 48888

( * ) Notice: Subject to any disclaimer, the term of this patent is extended or adjusted under 35 U.S.C. 154(b) by 0 days.

(21) Appl. No.: 12/210,227

(22) Filed: Sep. 15, 2008

(51) Int. Cl.
*A47G 29/12* (2006.01)

(52) U.S. Cl. ..... 232/38; 232/17

(58) Field of Classification Search ..... 232/38, 232/17, 45, 39; D99/29–32
See application file for complete search history.

(56) References Cited

U.S. PATENT DOCUMENTS

| | | | | |
|---|---|---|---|---|
| 2,025,251 | A | 12/1935 | Steinbronn | |
| D154,234 | S | 6/1949 | Batzler | |
| 3,243,104 | A | 3/1966 | Fillion | |
| 4,955,534 | A | 9/1990 | Raible | |
| D342,367 | S | 12/1993 | Lamancusa | |
| D348,554 | S | 7/1994 | Shapiro | |
| 5,365,611 | A * | 11/1994 | Chiles et al. | 2/16 |
| D377,256 | S | 1/1997 | Parrish | |
| 5,806,758 | A | 9/1998 | Erwin | |
| D423,756 | S | 4/2000 | Borer | |
| D479,382 | S | 9/2003 | Yeager | |
| D484,668 | S | 12/2003 | Morgan | |
| D488,610 | S | 4/2004 | Coleman | |
| 6,974,073 | B1 | 12/2005 | Snyder | |
| D516,270 | S | 2/2006 | Mathis | |
| 7,172,163 | B1 | 2/2007 | Johnson | |
| D547,925 | S | 7/2007 | Schappler | |
| D548,925 | S | 8/2007 | Haberman | |
| 7,364,066 | B1 * | 4/2008 | Wilson | 232/17 |
| 2006/0145048 | A1 | 7/2006 | Robinson | |

* cited by examiner

*Primary Examiner*—William L. Miller

(57) ABSTRACT

A mailbox has four sides generally forming a triangular enclosure to deflect snow thrown by the snowplow.

11 Claims, 3 Drawing Sheets

MAILBOX

TECHNICAL FIELD OF THE INVENTION

The present invention relates to the general art of mailboxes, and to the particular field of mailboxes that are resistant to external damage.

BACKGROUND OF THE INVENTION

In rural areas, it is common for mailboxes to be mounted on posts at the roadside. In many instances, a mail box may be damaged or broken off due to impact from the snow from the snowplow, and other foreign objects such as ice, dirt, stone, etc. Therefore, there is a need for a mailbox that can deflect the snow thrown by the snowplow to minimize the damage on the mailbox.

SUMMARY OF THE INVENTION

The above-discussed disadvantages of the prior art are overcome by a mailbox having bottom that can deflect snow thrown by the snowplow such as a V-shape or concave bottom. The bottom of the mailbox is configured to minimize the impact from snow thrown upwards by a snowplow to minimize damage on the mailbox. In one example, the mailbox may generally have a tetrahedron shape that can be generally defined as having four triangular plates, three of which meet at their respective vertex.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGS.

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1C:
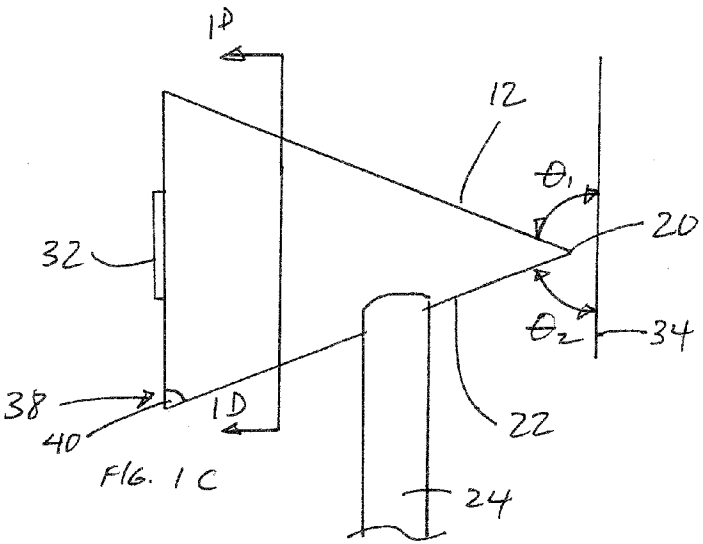
FIG. 1C is a side view of the mailbox shown in FIG. 1A.
Figure 1D:
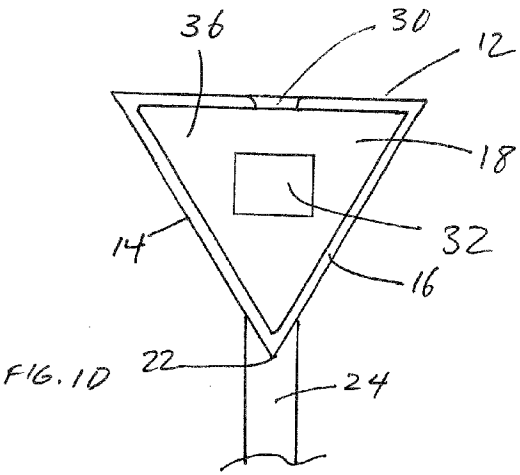
FIG. 1D is a cross-sectional view of the mailbox shown in FIG. 1C along the line 1D-1D.
Figure 1A:
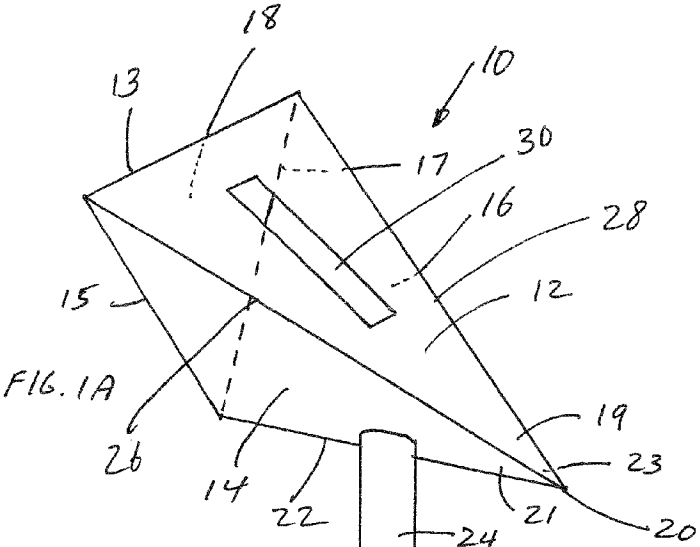
FIG. 1A is a perspective view of a mailbox embodying the present invention.
Figure 1B:
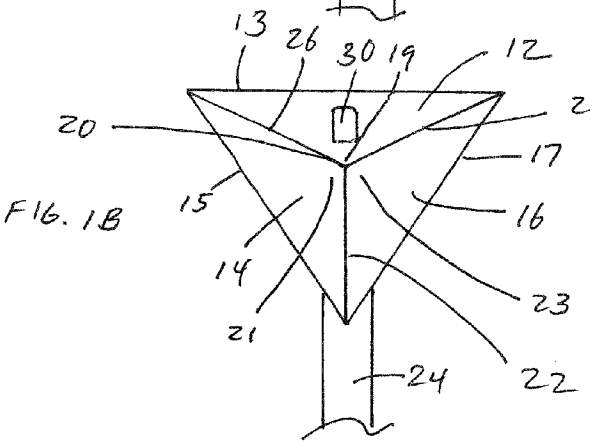
FIG. 1B is a front view of the mailbox shown in FIG. 1A.

FIGS. 1A-1D shows a mailbox 10 that resists damage due to snow, ice and the like being thrown up towards the mailbox 10 by a snowplow and the like. FIG. 1B shows the mailbox 10 having a first plate 12, a second plate 14, a third plate 16, and a fourth plate 18. Each of the four plates may have a triangular outer configuration. The first, second, and third plates may have a first base 13, a second base 15, and a third base 17, respectively; and first tip 19, a second tip 21, and a third tip 23, respectively. The first, second, and third tips are distal from their respective first, second, and third bases.

The first, second, and third plates may be joined together so that the first, second, and third tips 19, 21, and 23 are joined together to form a common tip 20, which is distal from the three bases 13, 15, and 17. The common tip 20 may be rounded. The second and third plates 14 and 16 may have a substantially similar outer triangular shape joined together at a seam-line 22. The second and third plates 14 and 16 may be adapted to receive one end of a post 24 along the seam-line 22 when the mailbox 10 is in use. The first plate 12 may be joined to the second and third plates 14 and 16 along the seam-lines 26 and 28, respectively. The first plate 12 may have an opening 30 adapted to receive one or more mails. The outer edges of the fourth plate 18 may be coupled to the bases 13, 15, and 17. The fourth plate may have a door 32 that opens and closes to retrieve the mail in the mailbox 10. As described above, the four plates 12, 14, 16, and 18 may form a mailbox 10 having a triangular enclosure.

FIG. 1C shows the side view of the mailbox 10. The first plate 12 may be orientated to have an acute angle θ1 relative to a vertical axis 34 when the mailbox is in use such that the first plate 12 is facing towards the common tip 20. This makes it easier to insert a mail into the opening 30 of the first plate 12; and any water from rain or from sprinkler system will tend to roll off the first plate 12 rather than resting on the first plate 12. The seam-line 22 may also form an acute angle θ2 relative to a vertical axis 34 when the mailbox is in use. As such, any water that enters the mailbox 10 may flow towards the bottom corner 38. The bottom corner 38 may have an outlet opening 40 to drain the water that enters the mailbox 10 so that mails do not get wet.

FIG. 1D shows a cross-sectional view of the mailbox 10 along the line 1D-1D of FIG. 1C. The cross-section generally shows a triangular formation with a space 36 inside for one or more mailers. FIG. 1D shows the inner surface of the fourth plate 18 having the door 32 that can open and close to retrieve the mailer inside the mailbox 10. The second and third plates 14 and 16 may be substantially flat surfaces forming a V-shape bottom when the mailbox 10 is in use. As such, snow thrown towards the bottom of the mailbox 10 can be deflected to minimize the direct impact on the mailbox, thereby minimizing the potential damage the snow can have on the mailbox 10.

Figure 2B:
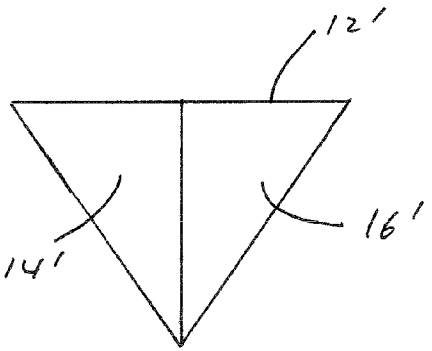
FIG. 2B is a front view of the mailbox shown in FIG. 2A.
Figure 2A:
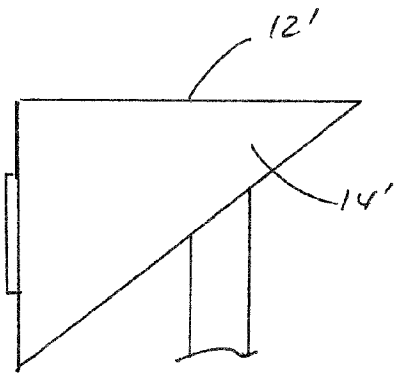
FIG. 2A is a side view of a mailbox having a modified shape.
Figure 3B:
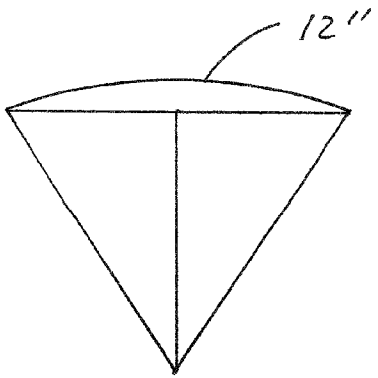
FIG. 3B is a front view of the mailbox shown in FIG. 3A.
Figure 3A:
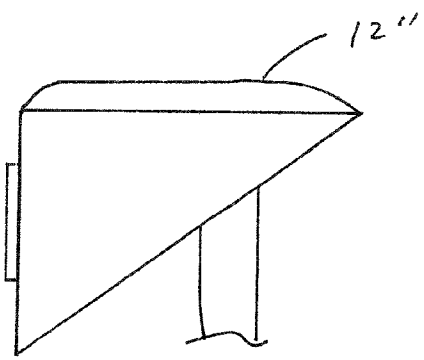
FIG. 3A is a side view of yet another mailbox having a modified shape.
Figure 5:
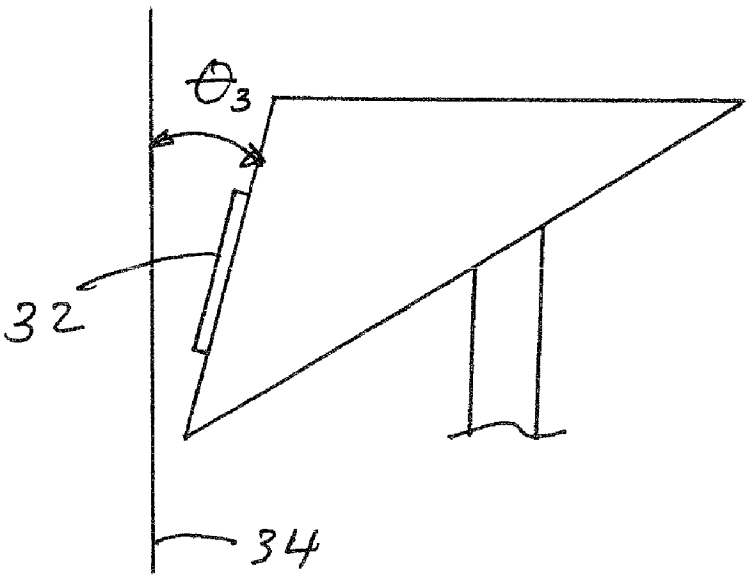
FIG. 5 is a side view of a still another mailbox having a modified shape.
Figure 4:
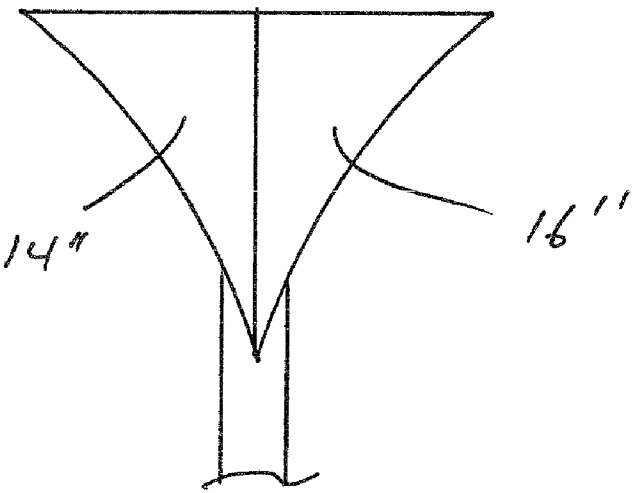
FIG. 4 is a front view of a mailbox having a modified shape.

While various embodiments of the invention have been described, it will be apparent to those of ordinary skill in the art that many more embodiments and implementations are possible within the scope of this invention. For instance, FIGS. 2A and 2B show that the first plate 12' may be substantially flat and horizontal when in use. FIGS. 3A and 3B show that the first plate 12" may be semi-circular. FIG. 4 show that the second and third plates 14' and 16' may be concaved. FIG. 5 show that the fourth plate 18' may be substantially flat and orientated to have an acute angle θ3 relative to the vertical axis 34. This allows the door 32 to remained opened once it is opened. Accordingly, the invention is not to be restricted except in light of the attached claims and their equivalents.

What is claimed is:

1. A mailbox comprising:

a first plate having a triangular outer configuration with a first base and a first tip, the first tip being distal from the first base, the first plate having an elongated opening to receive mail;

a second plate having a triangular outer configuration with a second base and a second tip, the second tip being distal from the second base;

a third plate having a triangular outer configuration with a third base and a third tip, the third tip being distal from the third base, the first, second, and third tips joined together at a common tip, the second and third plates joined together along a seam-line and adapted to receive one end of a post such that the second and third plates form a bottom of the mailbox when in use; and a fourth plate having a triangular outer configuration, the outer configuration of the fourth plate coupled to the first, second, and third bases, and the fourth plate having a door to retrieve mail in the mailbox.

2. The mailbox according to claim 1, where the second and third plates are flat.

3. The mailbox according to claim 1, where the second and third plates are concave.

4. The mailbox according to claim 1, where the first plate is orientated at an acute angle relative to a vertical axis when the mail box is in use.

5. The mailbox according to claim 1, where the first plate is substantially flat and is orientated in a horizontal manner when the mail box is in use.

6. The mailbox according to claim 1, where the second, third, and fourth plates are joined together at a bottom corner, the bottom corner having an opening.

7. The mailbox according to claim 1, where the first, second, third, and fourth plates are flat such that the four plates form a triangular enclosure.

8. The mailbox according to claim 1, where the seam-line is orientated to have an acute angle relative to a vertical axis when the mailbox is in use.

9. The mailbox according to claim 1, where the fourth plate is orientated to have an acute angle relative to a vertical axis when the mailbox is in use.

10. The mailbox according to claim 1, where the first plate is semi-circular.

11. The mailbox according to claim 1, where the second and third plates substantially form a V-shape when the mailbox is in use.

* * * * *